US006731272B2

(12) United States Patent
Huang

(10) Patent No.: US 6,731,272 B2
(45) Date of Patent: May 4, 2004

(54) PSEUDO STATIC MEMORY CELL FOR DIGITAL LIGHT MODULATOR

(75) Inventor: Samson X. Huang, Saratoga, CA (US)

(73) Assignee: Intel Corporation, Santa Clara, CA (US)

( * ) Notice: Subject to any disclaimer, the term of this patent is extended or adjusted under 35 U.S.C. 154(b) by 473 days.

(21) Appl. No.: 09/768,028

(22) Filed: Jan. 22, 2001

(65) Prior Publication Data

US 2002/0097215 A1 Jul. 25, 2002

(51) Int. Cl.[7] ..... G09G 5/00
(52) U.S. Cl. ..... 345/204; 345/87; 345/90
(58) Field of Search ..... 345/87, 204, 90, 345/92, 98, 103, 530

(56) References Cited

U.S. PATENT DOCUMENTS 4,432,610 A * 2/1984 Kobayashi et al. ..... 349/42
5,471,225 A * 11/1995 Parks ..... 345/98
5,748,165 A * 5/1998 Kubota et al. ..... 345/96
5,952,991 A * 9/1999 Akiyama ..... 345/98

FOREIGN PATENT DOCUMENTS

JP 57-25565 * 8/1983

* cited by examiner

*Primary Examiner*—Dennis-Doon Chow
(74) *Attorney, Agent, or Firm*—Fish & Richardson P.C.

(57) ABSTRACT

A digital driver formed a liquid crystal uses a pseudo static memory cell formed of two transistors to hold the charge that will be applied to the different parts of the liquid crystal. The pseudo static memory is formed of two transistors, one of which is a pass transistor which passes the digital value and then goes into a high impedance date. The other transistor is a transistor configured to use its gate capacitance to store the charge. When the charge is above a specified level, it acts like a digital one and turns on the transistor. Conversely, when the charge is below level, it acts like a digital zero, turning off the transistor.

11 Claims, 1 Drawing Sheet

PSEUDO STATIC MEMORY CELL FOR DIGITAL LIGHT MODULATOR

BACKGROUND

Liquid crystals are used for displays in various technologies. A liquid crystal operates by electrically controlling an orientation of a special liquid crystal material. The orientation affects the intensity of the light passing through the liquid crystal. A liquid crystal cell is often built by sandwiching liquid crystal materials between a reflective electrode and a transparent top plate. The voltage on the electrode is changed to modulate the intensity of the light which is reflected from the electrode, and thereby change the effective gray level of the cell. An M×N active matrix can be formed using individual cells of this type. The voltage level on the electrodes is changed correspondingly to change the image that is displayed by the liquid crystal.

The electrodes in the cells can be driven through a pass gate, such as an NMOS or CMOS pass gate. The analog level modulates the liquid crystal. However, since the total number of cells can be large, not all of the cells are driven simultaneously. With K input signals, the active matrix can be accessed sequentially K cells at a time. A cell needs to hold its voltage value between the times when it is driven. A sample and hold circuit can be used in each cell. Sampling is done by switching the NMOS pass gate. The value is conventionally held by associating a capacitor with the electrode.

Leakage across the capacitor causes the voltage on the capacitor to drop over time. If the display has 256 grayscales, the capacitor may need to be refreshed before its voltage drops by $1/512$ or about 0.2 percent. This necessitates relatively large capacitors and a relatively high refresh frequency. Such a system is called an analog modulated silicon light modulator or SLM.

The polarity of driving the liquid crystal material should also be alternated to prevent the LC material from becoming permanently rotated. Systems often invert the voltage between the top plate and the electrode during odd cycles.

BRIEF DESCRIPTION OF THE DRAWINGS

These and other aspects will now be described in detail with reference to the accompanying drawings, wherein.

DETAILED DESCRIPTION

A high analog voltage is often needed to achieve desired gray levels for analog modulation. However, binary voltage level pulse width modulation may be used to obtain the gray level temporally and to thereby lower the voltage requirement.

A digital static memory can be used to avoid the need for refresh. The digital static memory can use an 8 bit digital interface. Digital words are written to the memory indicative of the color or grayscale to be written in the cell. For an 8-bit per color display device, eight SRAM cells may be needed in each pixel. A typical SRAM cell may have six transistors. This means, therefore, that a large number of transistors, e.g., 48 transistors, may be required in each pixel for 8 digit memory.

An embodiment described herein uses as special kind of cell instead of the SRAM. This cell uses a two transistor pseudostatic memory cell for each bit of the interface. This system can reduce the physical size of the memory cell.

Figure 1:
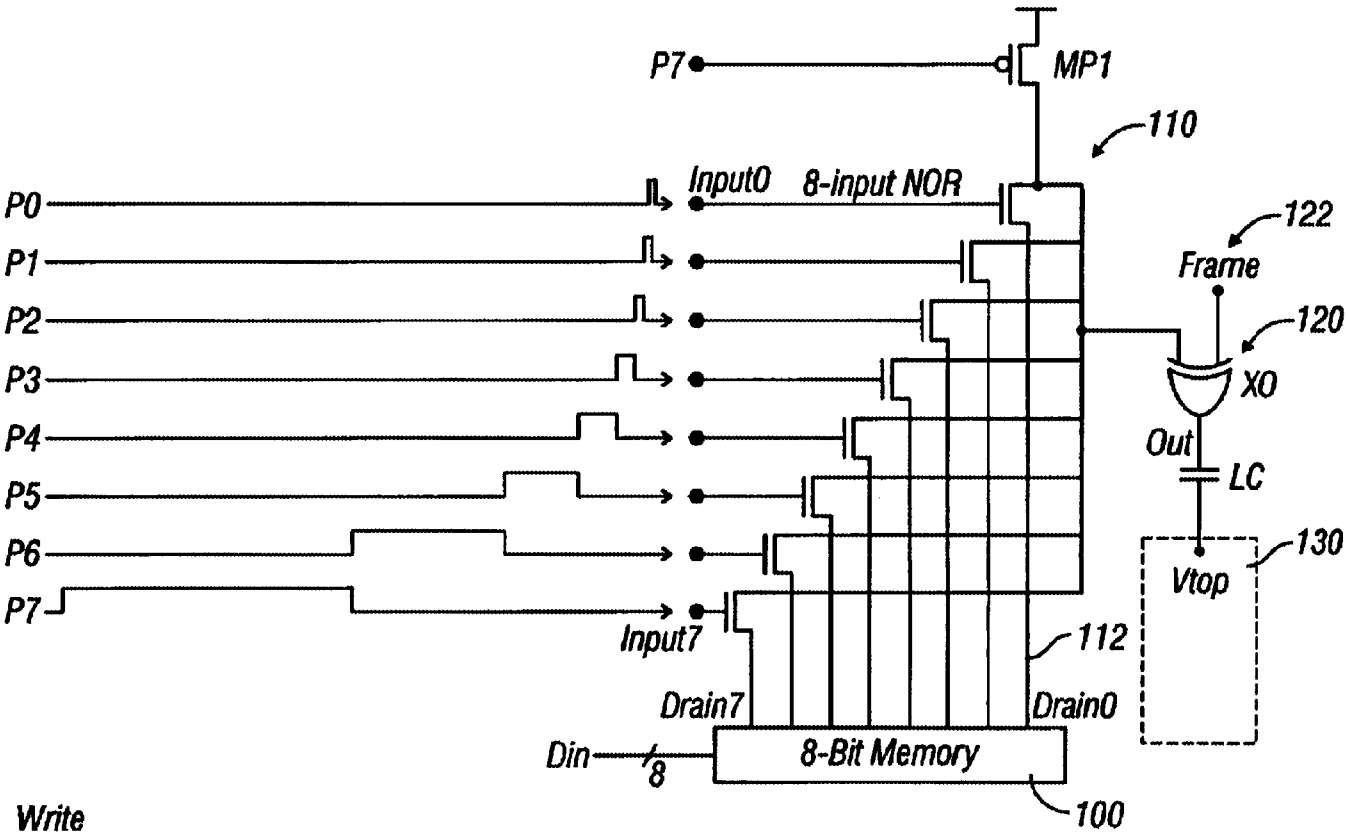
FIG. 1 shows a schematic of an embodiment.

FIG. 1 shows an embodiment using 8 bits. 8 bits will allow representing 256 gray levels. Of course, other numbers of bits could alternatively be used. The system shown in FIG. 1 uses an 8-bit memory 100 to store the values that will be used to drive the liquid crystal. An eight input nor gate 110 has its pulldown portions 112 connected to the memory.

The bits in the memory control pulldowns associated with the nor gate 110. Each bit in the memory can cause the associated line in the nor gate to be grounded or floating. The least significant bit connects to drain 0 of the nor gate 110. The most significant bit connects to drain 7 of the nor gate 110. Therefore, if the second bit of the memory is "0", the second NMOS pass gate is not pulled down even when the second input to the nor gate is high. However, if the memory bit is "1", when the input to the nor gate 110 goes high, the associated NMOS pass gate produces its output.

An exclusive or gate 120 passes the output of the eight input nor gate 110.

Global pulse width modulation signals P0 to P7 each respectively control one input of the nor gate. For example, input 0 of the nor gate is connected to P0, input 1 is connected to P1, and so forth. The other, "pulldown", inputs of the nor gate are connected to the memory 100. Each output connects to a specified input of the nor gate.

Nor gate 110 is connected to one input of the exclusive OR gate. The second input of the exclusive or gate 120 is connected to the frame signal 122. The output of the exclusive or gate 120 is connected to the electrode that supplies the bias voltage to the liquid crystal material. The other end of the liquid crystal material, the top plate, is connected to the bias voltage Vtop.

Each of the different pulse width modulated signals each have different duty cycles. P7 has a one-half duty cycle, P6 has a one-fourth duty cycle, and so on, with each signal having half of the duty cycle of the the signal before it. The last signal, P0 has a $1/256$ duty cycle.

During the active portion of the signal, the parts P0–P7 are high. During the inactive period of the signal, the signals remain low. During a given cycle, the total active duration of the output node is related to the sum of the active periods of the pulse width modulated signal with their corresponding drains being pulled down by the values in the memory 100. Therefore, the data in the memory controls the gray level through temporal modulation.

An alternating liquid crystal bias can be applied during positive and negative frames as controlled by the top plate voltage Vtop. During a positive frame, the top plate voltage may be negative. The frame signal is high during this time, so that when the nor gate output is low, the output signal becomes high. During negative frames, the top plate voltage is high and the frame signal is low, leading to the opposite sense. This causes the bias on the liquid crystal material to be inverted at alternate cycles.

Bandwidth savings can be obtained from the reduced need for refresh.

In this embodiment, each bit of the memory 100 is formed by a pseudo static memory cell. In an embodiment, this cell has only two transistors. Since this replaces the six transistor SRAM cell described above, a significant savings can be expected. If eight memory cells are used in each pixel, for example, this can provide a savings of 8×4=32 transistors per cell. This can be a significant savings in chip size.

Figure 2:
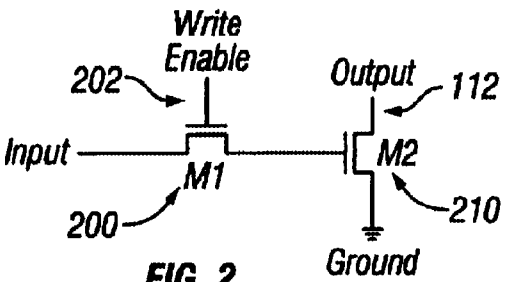
FIG. 2 shows a detail of a memory cell.

FIG. 2 shows a detail of the pseudo static memory cell used in the 8-bit memory 100 shown in FIG. 1. A first transistor M1/200 has a write enable input 202. When this write enable is high, the transistor 200 is turned on. This couples the input signal through the transistor. A second transistor M2/210 receives the coupled signal at its base. Therefore, while write enable 202 is active, the value of the input pin 200 is simply passed to the memory cell M2. When the write enable becomes inactive, the transistor Ml turns off. This provides a high impedance value.

The transistor 210 inherently has capacitance at its gate, referred to herein as the gate capacitance. When the write enable signal 202 is made inactive, and the high impedance is produced, the value previously applied to the gate capacitor is maintained in the form of charge storage at the gate capacitor inherently present at transistor M2. If a high charge is stored, M2 is on, thereby pulling down the output 112 to ground. If a low charge or zero charge is stored, 210 is turned off.

Charge at the gate of M2 will leak over time and degrade M2's gate voltage. However, since this is effectively digital storage, the logic state of transistor M2 will not change until the gate voltage drops below the threshold voltage Vth. For a circuit with a 2.5 V power supply, the voltage drop tolerance may be greater than 60 percent. Comparing this to the 0.2 percent voltage drop sensitivity in an analog system shows the advantages. The tolerance to voltage drop may be 300 times higher than the analog system. Hence, this system can use smaller capacitors and a lower refresh rate. For example, if the system refreshes at 2 MHz, the capacitors can still be 10 times smaller than that of an analog modulation SLM.

Although only a few embodiments have been disclosed in detail above, other modifications are possible. For example, the above system has described specific logic transitions. Of course, the opposite transition senses could also be used such a system. Also, this system has described using the inherent gate capacitance at the gate of a transistor. Other types of capacitance could be used for the digital storage.

All such modifications are intended to be encompassed within the following claims, in which:

What is claimed is:

1. A display driving device, comprising:

a memory, storing values for use in a specified portion of a display device, said memory including a plurality of elements collectively forming a number of bits of said display device, and each element of the memory including a first transistor configured to selectively pass an input signal, and a second transistor configured to store charge based on said input signal; and a liquid crystal driving part, including a plurality of pass gates, each controlled by dual inputs, one input of which is modulated, and the other input of which is from a corresponding one of said plurality of elements of said memory.

2. A device as in claim 1, wherein each element of said memory has said first transistor connected to receive a write enable signal to select whether said input signal will be passed, and said second transistor connected to receive said charge at its gate.

3. A device as in claim 1, wherein said second transistor of each element of said memory is connected between a corresponding one of said plurality of pass gates in said liquid crystal driving part and a voltage level.

4. A device as in claim 3, wherein said voltage level is ground.

5. A device as in claim 1, wherein said modulated input is pulse width modulated.

6. A device as in claim 1, further comprising a polarity changing part, which periodically changes a polarity of an output signal of said liquid crystal driving part.

7. A device as in claim 1, further comprising a liquid crystal element, connected to an output of said liquid crystal driving part.

8. A device as in claim 7, for comprising a frame inversion part, connected to invert a polarity applied to said liquid crystal element at alternate frames.

9. A device as in claim 5, wherein said pulse width modulated signal includes a plurality of signals, each having a different pulse width modulation, and each connected to said one inputs of said liquid crystal driving part.

10. A device as in claim 8, wherein said frame inversion part includes an exclusive or gate.

11. A device as in claim 1, wherein said memory has eight elements, and said liquid crystal driving part has eight pass gates.

* * * * *